US008210346B2

(12) United States Patent
Johnson et al.

(10) Patent No.: US 8,210,346 B2
(45) Date of Patent: Jul. 3, 2012

(54) LIGHT WEIGHT AND COLLAPSIBLE WEAPONS CONTAINER

(75) Inventors: Robert P. Johnson, Tucson, AZ (US); Charles A. Howland, Temple, NH (US); Jay A. Stern, Oro Valley, AZ (US)

(73) Assignees: Raytheon Company, Waltham, MA (US); Warwick Mills, Inc., New Ipswich, NH (US)

( * ) Notice: Subject to any disclaimer, the term of this patent is extended or adjusted under 35 U.S.C. 154(b) by 76 days.

(21) Appl. No.: 12/408,873

(22) Filed: Mar. 23, 2009

(65) Prior Publication Data

US 2010/0236945 A1 Sep. 23, 2010

(51) Int. Cl.
*B65D 85/00* (2006.01)

(52) U.S. Cl. ..... 206/317; 206/522; 206/524; 206/585; 206/594

(58) Field of Classification Search ..... 206/3, 317, 206/523, 599, 600, 597, 386, 524, 585, 591–594, 206/522, 584; 53/452, 472
See application file for complete search history.

(56) References Cited

U.S. PATENT DOCUMENTS

| | | | | |
|---|---|---|---|---|
| 2,904,207 | A * | 9/1959 | Kerstner et al. | 217/53 |
| 4,184,801 | A | 1/1980 | Nicoloff et al. | |
| 4,538,723 | A * | 9/1985 | Johnson et al. | 206/3 |
| 5,660,913 | A | 8/1997 | Coppage, Jr. | |
| 5,865,334 | A | 2/1999 | Ruiz et al. | |
| 6,357,582 | B1 | 3/2002 | Fischer | |
| 6,454,085 | B1 * | 9/2002 | Barker | 206/3 |
| 7,225,632 | B2 * | 6/2007 | Derifield | 62/372 |
| 2002/0064318 | A1 | 5/2002 | Malone et al. | |
| 2003/0217948 | A1 * | 11/2003 | Lantz | 206/591 |
| 2005/0150781 | A1 * | 7/2005 | Barton et al. | 206/3 |
| 2005/0179235 | A1 * | 8/2005 | Stewart et al. | 280/656 |
| 2008/0137997 | A1 | 6/2008 | Perkins | |
| 2008/0223857 | A1 | 9/2008 | Palley et al. | |
| 2009/0026196 | A1 | 1/2009 | Leedekerken | |

FOREIGN PATENT DOCUMENTS

WO WO-2010141042 A1 12/2010

OTHER PUBLICATIONS

"International Application Serial No. PCT/US2010/000611, Search Report mailed Nov. 8, 2010", 4 pgs.
"International Application Serial No. PCT/US2010/000611, Written Opinion mailed Nov. 8, 2010", 10 pgs.

* cited by examiner

*Primary Examiner* — Jacob K Ackun
*Assistant Examiner* — Jenine Pagan
(74) *Attorney, Agent, or Firm* — Schwegman, Lundberg & Woessner, P.A.

(57) ABSTRACT

A munitions container includes an inner container and an outer container formed of a fibrous material. A form is positioned within the inner container and receives munitions. The outer container is placed on a rigid baseplate.

31 Claims, 8 Drawing Sheets

LIGHT WEIGHT AND COLLAPSIBLE WEAPONS CONTAINER

TECHNICAL FIELD

The present invention relates to weapons containers, and in an embodiment, but not by way of limitation, a light weight and collapsible weapons container.

BACKGROUND

Robust, airtight containers are required for safe storage and transport of munitions and/or weapons. Typical munitions containers are made out of steel, and are therefore rigid and heavy, and are not collapsible or disposable after use. They also occupy a fixed volume whether they are loaded with munitions or they are empty. The same shipping volume is therefore required whether being shipped to the point of use (e.g. a Navy ship or a battlefield) or being returned empty from the point of use. Additionally, the mass of an empty container may be comparable to or even much larger than the mass of the munitions themselves. Thus, in light of these shortcomings, the art would benefit from an improved munitions container.

DETAILED DESCRIPTION

Figure 1A:
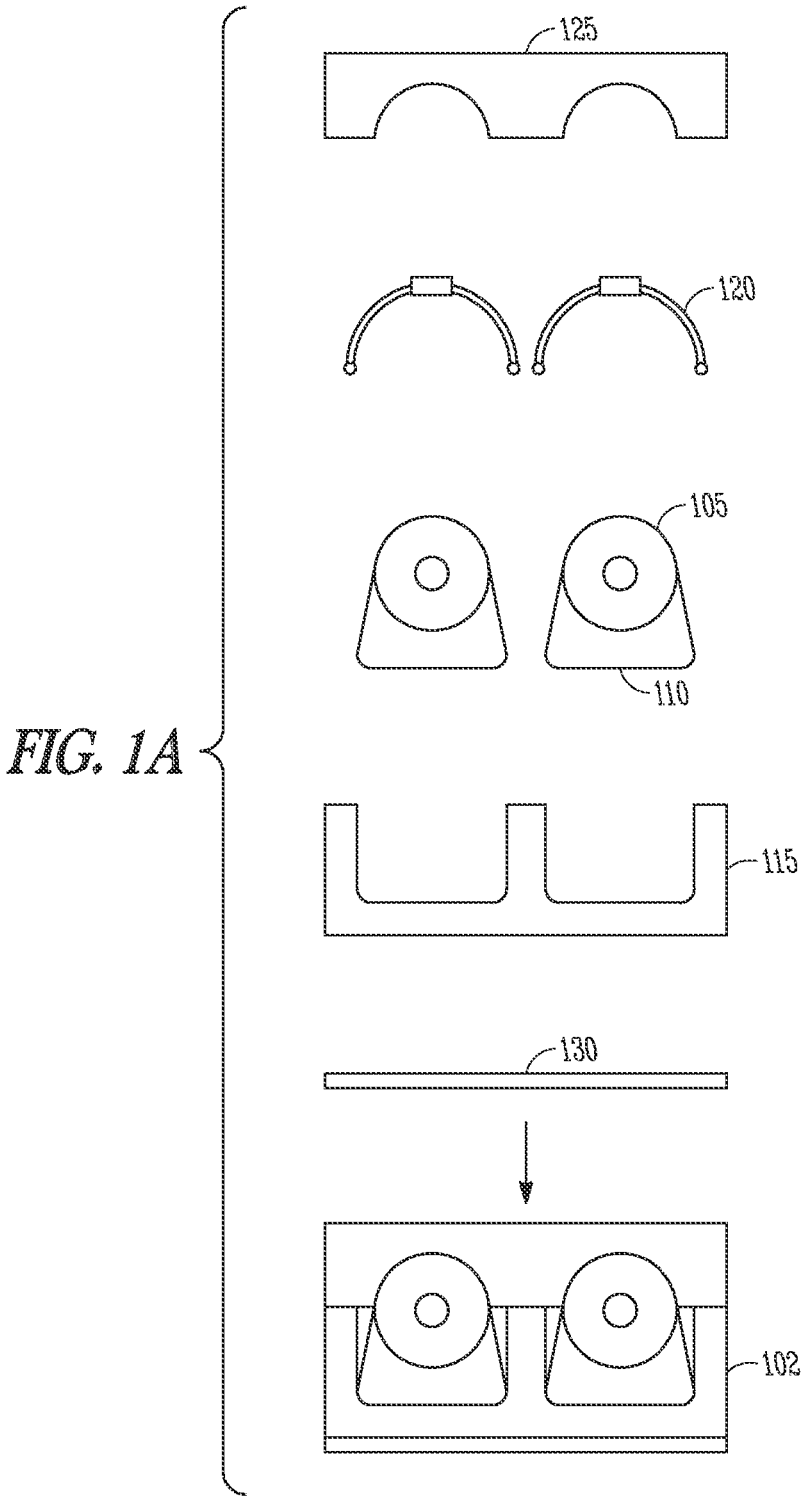
FIGS. 1A and 1B are exploded views of an example embodiment of a weapons container.

In the following detailed description, reference is made to the accompanying drawings that show, by way of illustration, specific embodiments in which the invention may be practiced. These embodiments are described in sufficient detail to enable those skilled in the art to practice the invention. It is to be understood that the various embodiments of the invention, although different, are not necessarily mutually exclusive. For example, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout the several views.

This disclosure relates to a light weight and collapsible weapons and munitions container that can be assembled in the field (e.g., a munitions plant). The container is made of fabric and polymeric materials, and includes sparsely located metal reinforcements around the outside perimeter of the container. The container is collapsible after use. The munitions container has improved chemical and moisture resistance. The materials and construction of the container decreases the overall weight of a munitions container system, as compared to prior art munitions container systems.

In an embodiment, a munitions container includes an inner container and an outer container. The inner and outer containers are formed out of a fibrous material. The munitions container further includes a form for receiving munitions that is placed within the inner container. The outer container rests on a rigid baseplate. At least a portion of the fibrous material comprises fiber of greater than 10 grams per denier.

Figure 5:
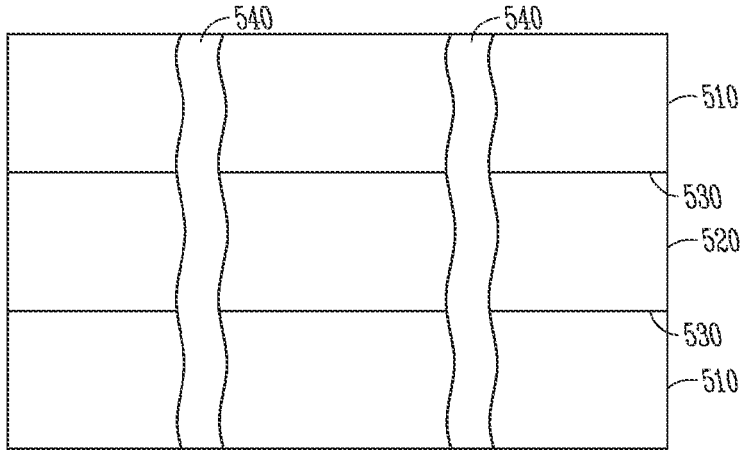
FIG. 5 is a cross section of a fabric for a container wall.

In a particular embodiment, the inner container and the outer container include at least two layers of the fibrous material 510 and at least one layer of a polymeric material 520 bonded to the at least two layers of the fibrous material as illustrated in FIG. 5. The bond 530 between the fibrous material and the polymeric material is able to withstand a force of at least 50 psi in shear. The layers of fibrous material can include a fibrous web within the layers of fibrous material. The layers of fibrous material and the layer of polymeric material have a density of less than 100 kg per cubic meter. The inner container and the outer container that are constructed of such a fibrous/polymeric layered fabric are capable of sustaining a blunt or cutting impact of at least 15 kJ/kg of mass and up to 150 kJ/kg of mass.

Figure 1B:
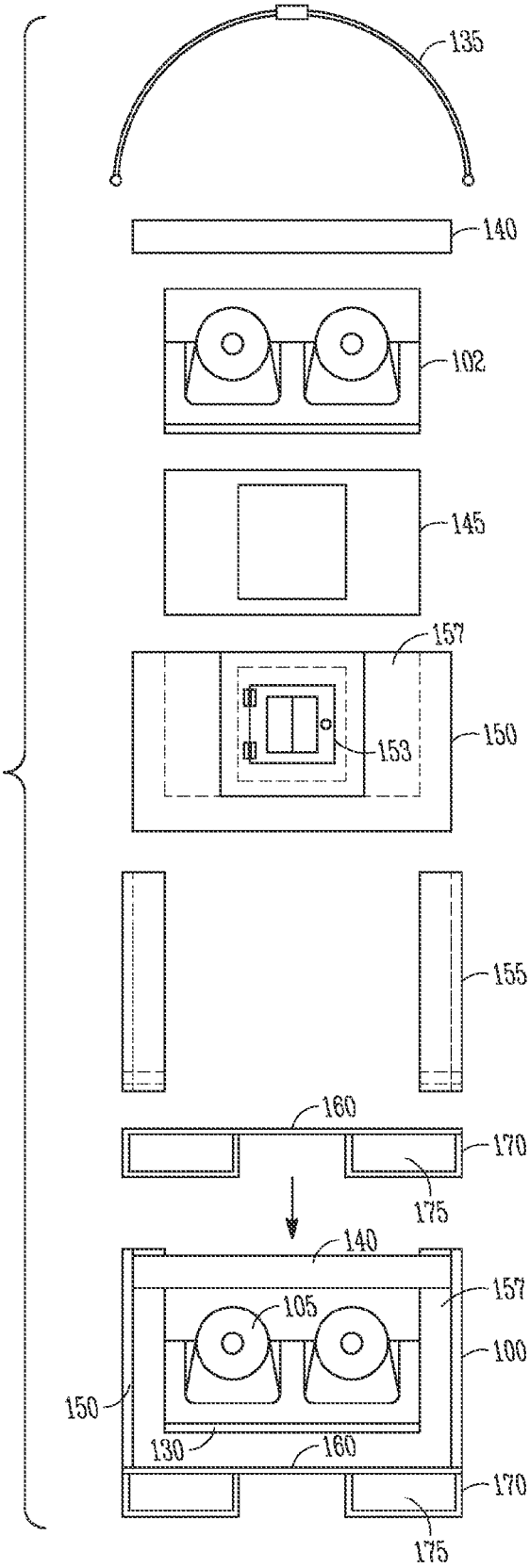

FIG. 1 is an exploded view of an example embodiment of a weapons container 100. A partially assembled embodiment of the container is shown at 102, and a fully assembled embodiment of the container is shown at 100 in FIG. 2B. Munitions and/or weapons 105 are positioned in a rack or support 110. The munitions and support are then positioned in a lower protective form 115. In an embodiment, the lower protective form 115 is constructed of a foam or foam-like material, which can be disposed of after the munitions are removed from the container 100. This reduces the amount of material that is returned to the munitions plant with the emptied container 100. Retention straps 120 are placed over the munitions 105 and lower protective form 115 to secure the munitions within the lower protective form. An upper protective form 125 is then placed over the munitions, lower protective form, and retention strap assembly. Like the lower protective form, the upper protective form can be made of foam or a foam-like material that can be disposed of after the removal of the munitions from the container 100. The assembly of the munitions, lower protective form, and upper protective form are secured to a base cradle plate 130 via the retention straps 120, and this assembly is shown at 102.

The bomb or base cradle plate 130 is a subassembly of the container 100 which when removed may be attached to a portable cart for transport to a host aircraft or other destination. Suitable lift points 180 (FIG. 2B) are provided to allow the cradle plate 130 to be hoisted into and out of the container 100. The bomb cradle plate 130 may be made from aluminum or from a lightweight aluminum honeycomb material.

The assembly 102 is placed into a bladder 145. The bladder 145 is preferably made out of a sturdy polymer-based material. The bladder can be made from a coated fabric using heat sealed seams. The bladder is airtight, and in one embodiment, the bladder is made airtight via a zipper such as a type used on a diving dry suit. As an alternative to first placing the assembly 102 into the bladder 145, the airtight bladder 145 is first inserted into the outer container 150, and then the assembly 102 is placed into the bladder 145 that is now inside the outer container 150. The bladder can include a cutout portion that matches an access port in the outer container 150. The bladder and access port can be joined and sealed by a gasket and retaining plate. An outer door 153 on the access port would include an airtight seal. Breather and bleeder valves could also be part of the access port door.

The outer container 150 can be manufactured out of a flexible sturdy material such as a liquid crystal polymer fabric. The fiber fabric can be coated with a flame and chemical resistant layer. A liquid crystal polymer fiber fabric has very high strength and a high modulus. One example of a liquid crystal polymer fiber fabric that may be suitable is Vectran® and 1500 dernier Vectran®, although the scope of the embodiment is not limited in this respect. The outer container 150 further includes the access door 153. An access port at the aft end of the bladder allows access into the airtight compartment where the munitions are stored. The access door and port also allow access to a storage area for munitions BIT cables, dessicants, and records. Rigid structure posts 155, which in one embodiment are made out of metal, are positioned around the outer container 150, such as at the four corners of the outer container. A foam or foam-like material 157 is placed into the outer container 150 such that it surrounds and secures the bladder 145 and the contents within the bladder. In an embodiment, the foam 157 is a mixture of two or more compounds, which are injected into the outer container 150 via ports and tunnels 540 (See FIG. 5) in the wall of the flexible material of the outer container, and which solidify around the bladder 145, thereby securing the bladder and its contents. The foam can be an expandable rigidizing urethane foam. The foam bonds to the fabric, creating a structure or form that strongly resists bending. A top plate 140 is placed over the outer container 150, and one or more retention straps 135 secure the outer container to a base weldment 160. The retention straps pass around the container and are terminated at the base weldment. A tensioning device can be used to tighten the retention straps. The base weldment can include footing 170, which can be configured with an opening 175 to receive the forks of a fork lift truck. There can be one or more openings 175 on any and all sides of the munitions container 100.

Figure 2C:
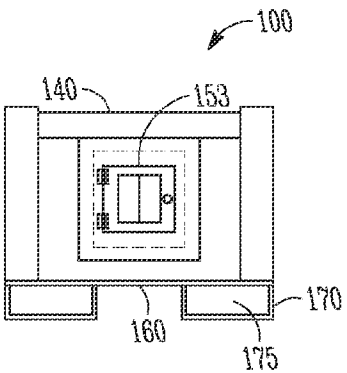
FIG. 2C is an end view of a weapons container.
Figure 2B:
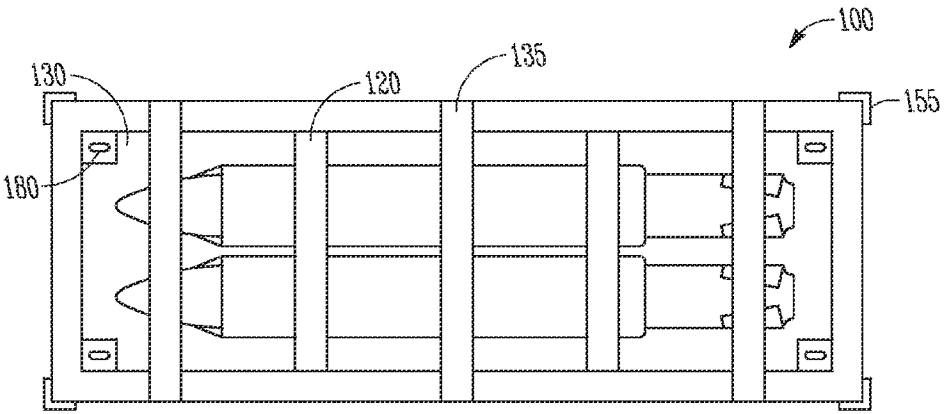
FIG. 2B is a plan view of a weapons container.
Figure 2A:
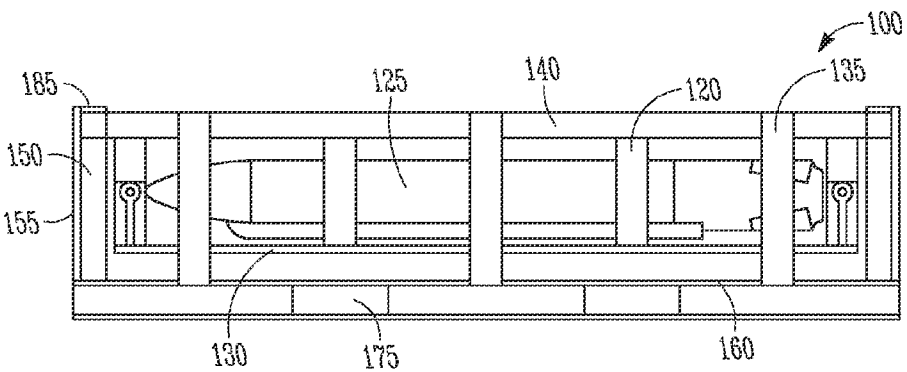
FIG. 2A is a side cross sectional view of a weapons container.

FIG. 2A shows a side cross sectional view of the weapons container 100. In FIG. 2B, the munitions 105 are positioned within the container 100, straps 135 are shown, and side access ports 175 for the forks of a fork lift truck are also illustrated. FIG. 2B is a plan view of the container 100, and it illustrates, among other features, lift points 180 that are coupled to the base cradle plate 130, and that can receive a hook or other device for lifting the base cradle plate 130 out of the outer container 150. FIG. 2C shows an end view of the container 100, including the access door 153.

Figure 3:
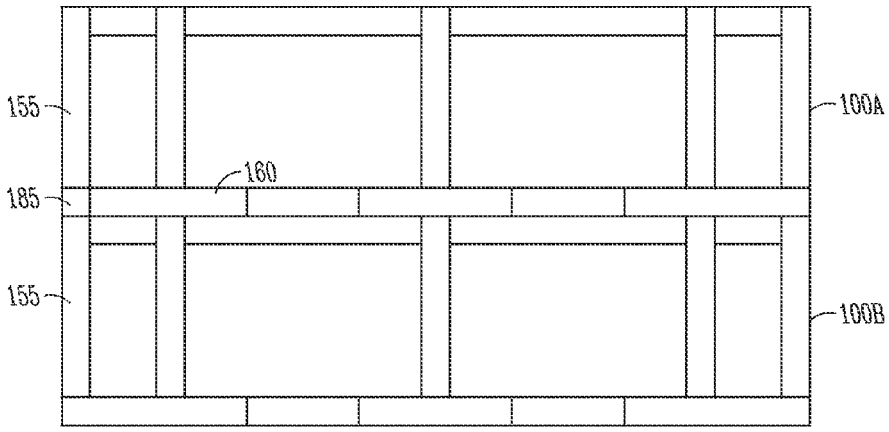
FIG. 3 is a side view of a first weapons container stacked on a second weapons container.

FIG. 3 is a side view of one container 100A stacked on a second container 100B. In an embodiment, the stackability of the containers is made possible by recesses 185 in the base weldment 160. The recesses 185 receive the rigid supports 155 in an interlocking fashion, thereby aligning and securing the top container 100A on the bottom container 100B, and transferring the weight of other containers through the rigid supports 155.

Figure 4A:
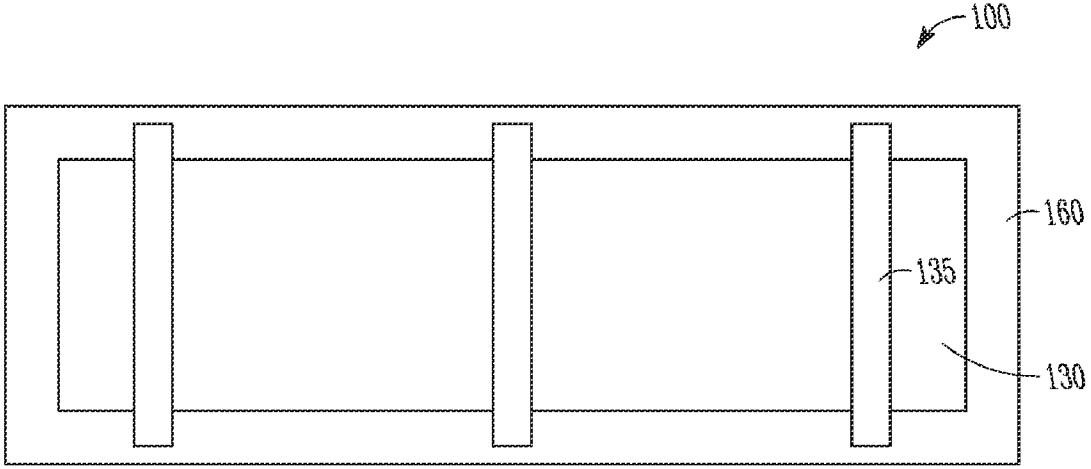
FIG. 4A is a plan view of a collapsed weapons container.
Figure 4C:
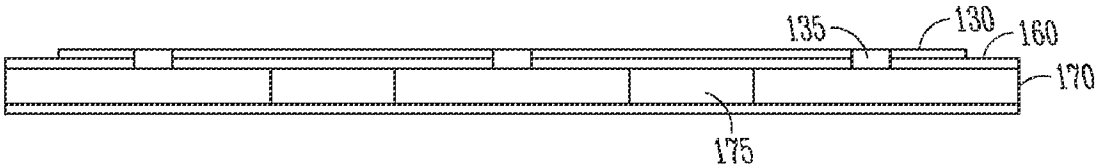
FIG. 4C is a side view of a collapsed weapons container.
Figure 4B:
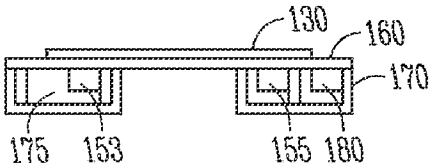
FIG. 4B is a end view of a collapsed weapons container.

FIG. 4A illustrates a plan view of a container 100 in a collapsed state with no weapons therein. FIG. 4A illustrates the base cradle plate 130 placed on the base weldment 160. The retention straps 135 secure the base cradle plate 130 to the base weldment 160. FIG. 4C shows a side view of the retention straps 135 securing the base cradle plate 130 to the base weldment 160. FIG. 4B illustrates an end view of the collapsed container 100. FIG. 4B, like FIGS. 4A and 4C, shows the base cradle plate 130 strapped to the base weldment 160, and further shows the supports 155, the lifting eyes 180, and the access door 153 stowed within the fork lift truck openings 175 in the footing 170.

Reusable elements of the container 100 include the base weldment 160 and footing 170, the rigid supports 155, the bomb cradle base plate 130, the lifting eyes 180, and the access door 153. Disposable elements include the outer container 150, the cover panel 140, and the lower and upper protective foam elements 115, 125.

Figure 6:
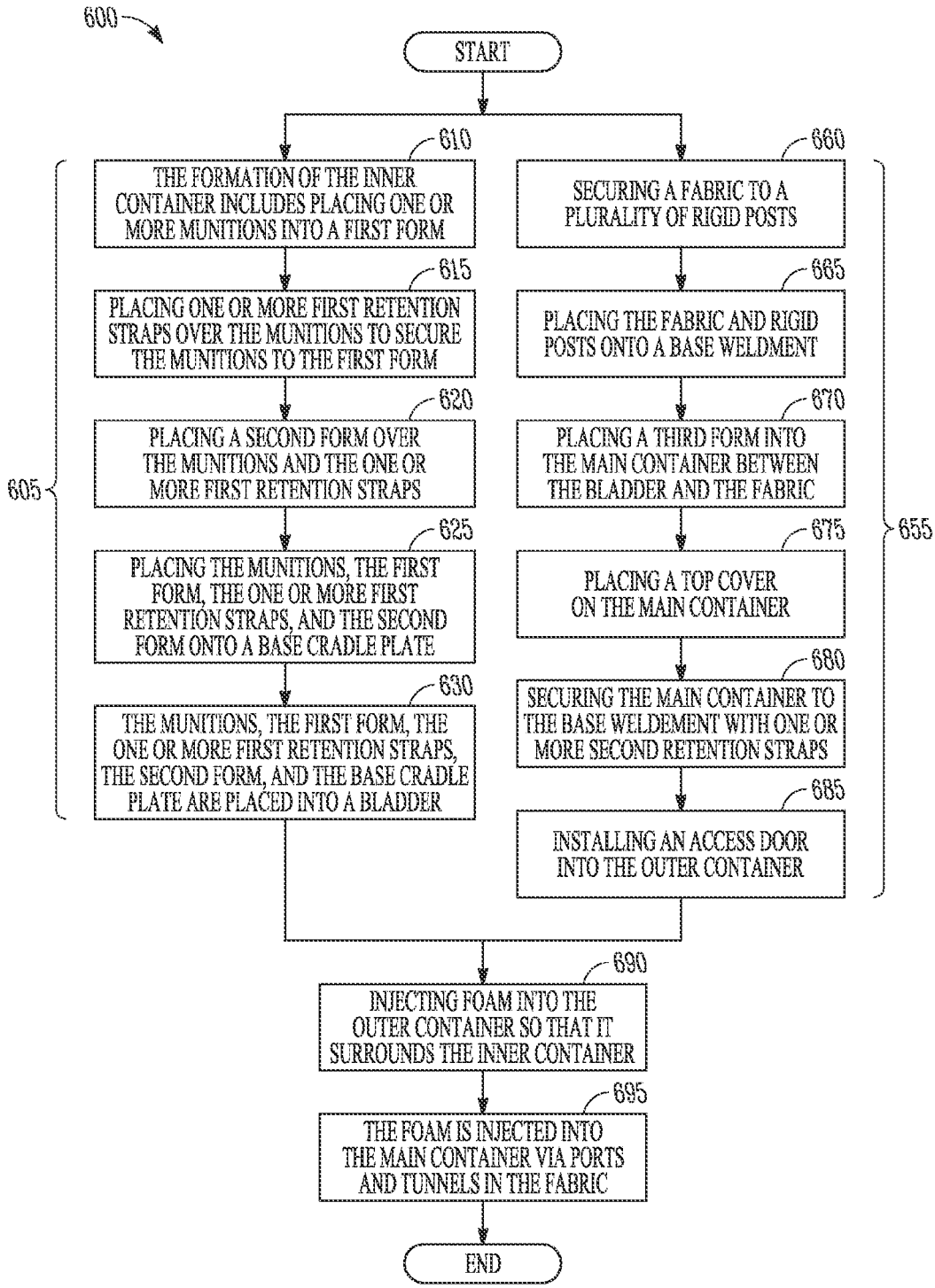
FIG. 6 is a flowchart of an example embodiment of a process to manufacture a collapsible weapons container.
Figure 7:
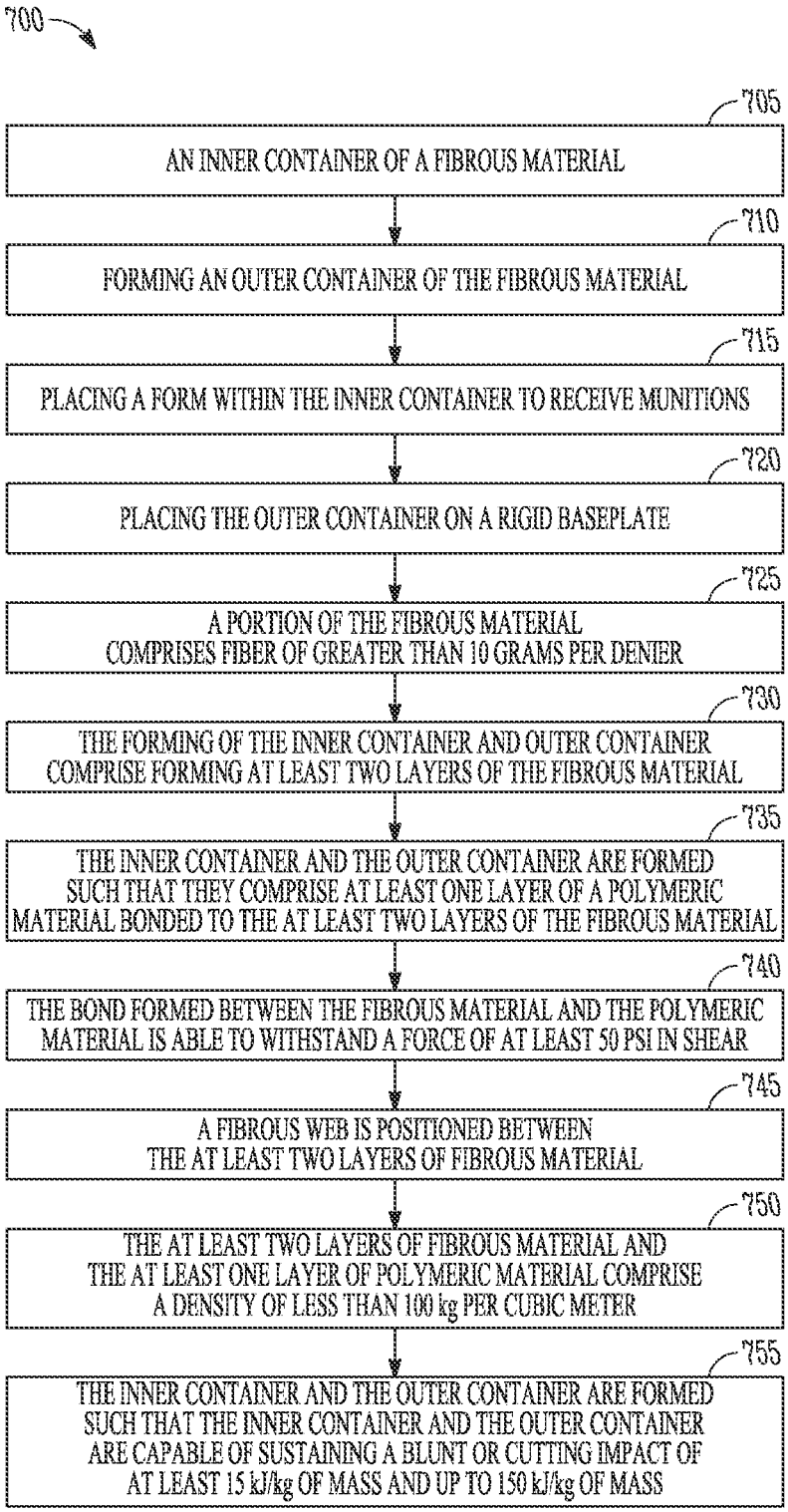
FIG. 7 is a flowchart of another example embodiment of a process to manufacture a collapsible weapons container.

FIGS. 6 and 7 are flowcharts of example processes 600 and 700 for manufacturing a light weight and collapsible weapons and munitions container. FIGS. 6 and 7 include a number of process blocks 605-695 and 705-755 respectively. Though arranged serially in the examples of FIGS. 6 and 7, other examples may reorder the blocks, omit one or more blocks, and/or execute two or more blocks in parallel using multiple processors or a single processor organized as two or more virtual machines or sub-processors. Moreover, still other examples can implement the blocks as one or more specific interconnected hardware or integrated circuit modules with related control and data signals communicated between and through the modules. Thus, any process flow is applicable to software, firmware, hardware, and hybrid implementations.

Process 600 includes forming an inner container at 605 and forming at outer container at 655. The formation of the inner container includes placing one or more munitions into a first form at 610, placing one or more first retention straps over the munitions to secure the munitions to the first form at 615, placing a second form over the munitions and the one or more first retention straps at 620, and placing the munitions, the first form, the one or more first retention straps, and the second form onto a base cradle plate at 625. The munitions, the first form, the one or more first retention straps, the second form, and the base cradle plate are placed into a bladder at 630. The outer container is formed at 655 by securing a fabric to a plurality of rigid posts at 660, placing the fabric and rigid posts onto a base weldment at 665, placing a third form into the main container between the bladder and the fabric at 670, placing a top cover on the main container at 675, and securing the main container to the base weldment with one or more second retention straps at 680. The process 600 further includes installing an access door into the outer container at 685, and injecting foam into the outer container at 690 so that it surrounds the inner container. At 695, the foam is injected into the main container via ports and tunnels in the fabric.

Process 700 includes forming an inner container of a fibrous material at 705, forming an outer container of the fibrous material at 710, placing a form within the inner container to receive munitions at 715, and placing the outer container on a rigid baseplate 720. A portion of the fibrous material comprises fiber of greater than 10 grams per denier (725). At 730, the forming of the inner container and outer container comprise forming at least two layers of the fibrous material. At 735, the inner container and the outer container are formed such that they comprise at least one layer of a polymeric material bonded to the at least two layers of the fibrous material. At 740, the bond formed between the fibrous material and the polymeric material is able to withstand a force of at least 50 psi in shear. At 745, a fibrous web is positioned between the at least two layers of fibrous material. The at least two layers of fibrous material and the at least one layer of polymeric material comprise a density of less than 100 kg per cubic meter (750). At 755, the inner container and the outer container are formed such that the inner container and the outer container are capable of sustaining a blunt or cutting impact of at least 15 kJ/kg of mass and up to 150 kJ/kg of mass.

In the foregoing detailed description of embodiments of the invention, various features are grouped together in one or more embodiments for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the detailed description of embodiments of the invention, with each claim standing on its own as a separate embodiment. It is understood that the above description is intended to be illustrative, and not restrictive. It is intended to cover all alternatives, modifications and equivalents as may be included within the scope of the invention as defined in the appended claims. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein," respectively. Moreover, the terms "first," "second," and "third," etc., are used merely as labels, and are not intended to impose numerical requirements on their objects.

The abstract is provided to comply with 37 C.F.R. 1.72(b) to allow a reader to quickly ascertain the nature and gist of the technical disclosure. The Abstract is submitted with the understanding that it will not be used to interpret or limit the scope or meaning of the claims.

The invention claimed is:

1. A munitions container comprising:
an inner container;
an outer container;
wherein the inner container comprises:
a first form to receive munitions; and
a base cradle plate for receiving the form and the munitions; and
wherein the outer container comprises:
a fabric material, the outer container for receiving the inner container;
one or more rigid supports for the outer container;
a top cover for the outer container; and
a base weldment to receive the outer container; and
a bladder for receiving the inner container.

2. The munitions container of claim 1, comprising:
a first retention strap for securing the munitions to the first form;
a second form for placement over the first retention strap and the munitions;
an access door coupled to the outer container;
a third form positioned between the bladder and the outer container; and
a second retention strap to secure the outer container to the base weldment.

3. The munitions container of claim 1, wherein the rigid supports are placed on one or more corners of the outer container.

4. The munitions container of claim 1, wherein the base weldment, the one or more rigid supports, the base cradle plate, and an access door are manufactured out of a reusable material.

5. The munitions container of claim 2, wherein the outer container, the top cover, and the first and second forms are manufactured out of a disposable material.

6. The munitions container of claim 1, comprising a footing coupled to the base weldment, the footing comprising an opening for fork lift access.

7. The munitions container of claim 6, wherein the footing is configured to allow fork lift access from any side of the munitions container.

8. The munitions container of claim 6, comprising one or more lifting eyes coupled to the base cradle plate.

9. The munitions container of claim 8, wherein when there are no munitions in the munitions container, the munitions container is configured such that the bomb cradle plate is secured to the base weldment, and the rigid supports, lifting eyes, and access door are configured such that they are storable in the footing.

10. The munitions container of claim 2, wherein the access door comprises one or more breather or bleeder valves.

11. The munitions container of claim 2, wherein the bladder comprises a zipper, and the zipper is configured to form an airtight seal.

12. The munitions container of claim 1, wherein the base weldment comprises one or more recesses for receiving the rigid supports.

13. The munitions container of claim 2, wherein the first form and the second form comprise a foam or foam-like material.

14. The munitions container of claim 1, wherein the fabric material comprises a liquid crystal polymer fiber fabric.

15. A munitions container comprising an inner container and an outer container, the inner container comprising:
a first form to receive the munitions;
a first retention strap for securing the munitions to the first form;
a second form for placement over the first retention strap and the munitions; and
a first base plate for receiving the first form, the first retention strap, the second form, and the munitions; and
the outer container comprising:
a bladder for receiving the inner container;
an access door;
one or more rigid supports for placing on the outer container;
a third form positioned between the air tight bladder and inner walls of the outer container;
a top cover for the outer container;
a second base plate for the outer container; and
a second retention strap to secure the outer container to the second base plate.

16. The munitions container of claim 15, wherein the first form and the second form comprise a foam or foam like material.

17. The munitions container of claim 15, wherein the third form comprises a mixture that is injected into the munitions container between the airtight bladder and the inner walls of the outer container.

18. The munitions container of claim 15, wherein the bladder comprises a zipper for rendering the bladder airtight.

19. The munitions container of claim 15, wherein the one or more rigid supports are placed on one or more corners of the outer container.

20. A munitions container comprising:
an inner container formed of a foam material;
a bladder for receiving the inner container;

an outer container formed of a fibrous material, the outer container for receiving the inner container and the bladder;

and a rigid baseplate for receiving the outer container;

wherein a portion of the fibrous material comprises fiber of greater than 10 grams per denier.

21. The munitions container of claim 20, wherein the outer container comprises at least two layers of the fibrous material; and the outer container comprises at least one layer of a polymeric material bonded to the at least two layers of the fibrous material.

22. The munitions container of claim 21, wherein the bond between the fibrous material and the polymeric material is able to withstand a force of at least 50 psi in shear.

23. The munitions container of claim 21, wherein the at least two layers of fibrous material comprise a fibrous web positioned between the at least two layers of fibrous material.

24. The munitions container of claim 21, wherein the at least two layers of fibrous material and the at least one layer of polymeric material comprise a density of less than 100 kg per cubic meter.

25. The munitions container of claim 20, wherein the outer container is capable of sustaining a blunt or cutting impact of at least 15 kJ/kg of mass and up to 150 kJ/kg of mass.

26. A method to containerize munitions comprising:

forming an inner container of a foam material;

placing the inner container into a bladder;

forming an outer container of a fibrous material, the outer container for receiving the inner container and the bladder;

and placing the outer container on a rigid baseplate;

wherein a portion of the fibrous material comprises fiber of greater than 10 grams per denier.

27. The method of claim 26, wherein forming the outer container comprises forming at least two layers of the fibrous material; forming the outer container such that it comprises at least one layer of a polymeric material bonded to the at least two layers of the fibrous material.

28. The method of claim 26, wherein the bond formed between the fibrous material and the polymeric material is able to withstand a force of at least 50 psi in shear.

29. The method of claim 26, comprising positioning a fibrous web between the at least two layers of fibrous material.

30. The method of claim 26, wherein the at least two layers of fibrous material and the at least one layer of polymeric material comprise a density of less than 100 kg per cubic meter.

31. The method of claim 26, comprising forming the outer container such that the outer container is capable of sustaining a blunt or cutting impact of at least 15 kJ/kg of mass and up to 150 kJ/kg of mass.

* * * * *